United States Patent [19]

Vickers

[11] 4,299,030

[45] Nov. 10, 1981

[54] HAND-OPERATED SHEARING DEVICES

[76] Inventor: David W. Vickers, 121 Wickham Terr., Brisbane, Australia, 4000

[21] Appl. No.: 106,456

[22] Filed: Dec. 26, 1979

[30] Foreign Application Priority Data

Dec. 28, 1978 [AU] Australia ..... PD7233

[51] Int. Cl.[3] ..... B26B 13/00

[52] U.S. Cl. ..... 30/261; 30/266

[58] Field of Search ..... 30/261, 266, 267, 268, 30/269, 253

[56] References Cited

U.S. PATENT DOCUMENTS

| | | | |
|---|---|---|---|
| 677,662 | 7/1901 | Hopkins | 30/268 |
| 1,486,165 | 3/1924 | Smith | 30/268 |
| 2,505,705 | 4/1950 | Cohn | 30/253 X |

FOREIGN PATENT DOCUMENTS

| | | | |
|---|---|---|---|
| 402695 | 9/1924 | Fed. Rep. of Germany | 30/261 |

*Primary Examiner*—Jimmy C. Peters

*Attorney, Agent, or Firm*—Lewis Messulam

[57] ABSTRACT

Spring scissors are provided in which, in addition to the resilient means which provide jaw-opening bias, lateral-urging means are provided, which act on the handles of the scissors to produce or mechanically augment the cross-cutting pressure between the blades.

2 Claims, 4 Drawing Figures

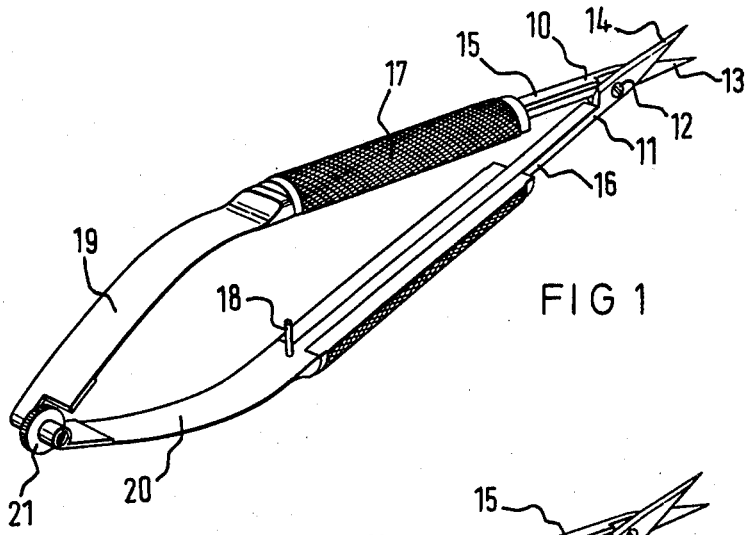
FIG 1
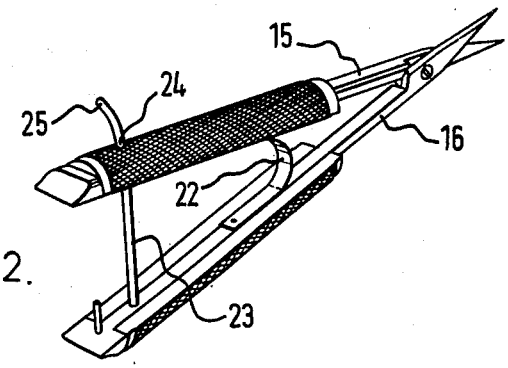
FIG.2.
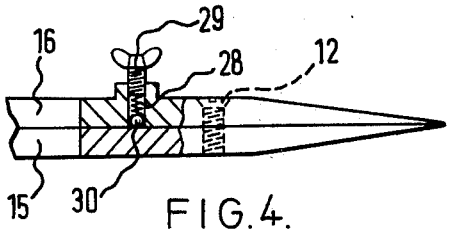
FIG.4.
FIG.3.
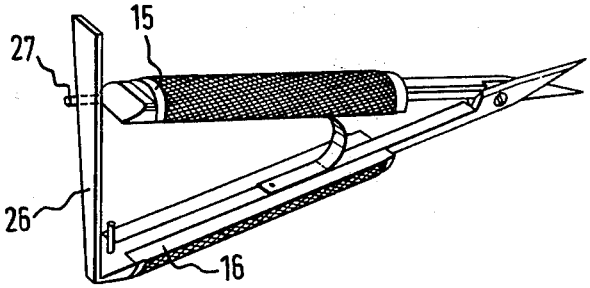

HAND-OPERATED SHEARING DEVICES

FIELD OF THE INVENTION

The present invention relates to improved hand-operated shearing devices, and more particularly to spring scissors having mechanically augmented cross-cutting pressure.

BACKGROUND OF THE INVENTION

Spring scissors are devices designed for use in either hand of the operator, they consist of a pair of pivotally connected members which are resiliently biased towards an open-jaw position. They are operated by a simple squeezing action, rather than the cross-cutting type of action which is permissible with conventional scissors which are provided with finger-receiving holes in their handles. Since a cross-cutting pressure, i.e. a force exerted by each blade against the other in a direction parallel to the pivot axis, is needed for successful shearing, the design of spring scissors has to compensate for the inability to impart such pressure manually.

In known spring scissors, cross-cutting is provided by virtue of the set of the blades. The latter which are made of spring steel are curved towards each other so that the cutting edges cross one another when the scissors are in their open-jaw configuration. However, the cross-cutting pressure produced in this way may be insufficient and a means of producing additional pressure mechanically is desirable.

OBJECT OF THE INVENTION

It is an object of the present invention to provide spring scissors of improved design which incorporate means, other than the set of the blades, for mechanically producing cross-cutting pressure between the blades.

SUMMARY OF THE INVENTION

The present invention provides a hand-operated shearing device which comprises a pair of members interconnected by pivot means located between a blade-portion and a handle-portion of each member, said pivot means permitting relative rotation of said members between an open-jaw configuration and a closed configuration, resilient jaw-opening means for urging said members towards said open-jaw configuration, wherein the improvement comprises resilient lateral-urging means effective throughout the range of rotational movement of said members to urge said handle-portions apart in a direction parallel to the axis of said rotation, whereby a surface of each of said blade-portions is urged into frictional contact with a surface of the other bladeportion.

In the devices of the invention the cross-cutting pressure need not be produced entirely by the action of the lateral-urging means. Preferably the blades are curved so that some cross-cutting pressure is provided by their set, and the lateral-urging means serves to augment the pressure between the blade faces.

According to one aspect of the invention, a single leaf-spring assembly interconnecting the handle-portions of the members of the scissors serves the dual function of a jaw-opening spring and a lateral-urging spring.

According to another aspect of the invention, lateral-urging is provided by interacting cam and cam-follower provided on the handle-portions of the scissors.

According to yet another aspect of the invention, lateral-urging is provided by a spring located in the box-junction of the scissors, i.e. near the pivot point between surfaces which overlap throughout the range of rotational movement.

Certain preferred embodiments of the invention have the added advantage that the cross-cutting pressure can be manually adjusted to the desired level.

The invention will now be specifically described with reference to preferred embodiments thereof.

BRIEF DESCRIPTION OF THE DRAWINGS

FIGS. 1 through 3 are perspective views of each of three alternative embodiments of the invention; and FIG. 4 is a cross-sectional view of the forward portion of a fourth embodiment of the invention.

Whenever possible in the drawings identical numerals denote similar parts of the various embodiments.

DETAILED DESCRIPTION OF THE EMBODIMENTS

In FIG. 1 a pair of scissors is shown which consists of a pair of members 10 and 11, pivotally interconnected by a pivot screw 12, located between blade-portions 13 and 14 and handle-portions 15 and 16 of the members. Each of the handle-portions is provided with knurled, part-cylindrical gripping surface 17. The handle-portion 16 carries a short post 18 which constitutes a limiting stop defining the closed configuration of the scissors.

A pair of leaf-springs 19 and 20 are connected to the extremeties of the handles 15 and 16 respectively, and are interconnected at their other extremeties by means of an axle (not illustrated), which lies parallel to the pivot screw 12, and to which a knurled adjusting wheel 21 is fixedly attached. The axle is threadably attached to at least one of the leaf-springs. If both extremities of the axle are threaded, the direction of the threads is such that when the axle is rotated by rotating the wheel 21, the spring ends are moved relative to one another along the axle. In this way a selectively adjustable lateral-urging force is produced at the axle and transmitted via the leaf-springs to the handles 15 and 16. The leaf-springs also serve to provide the jaw-opening bias of the scissors.

In the scissors of FIG. 2, jaw-opening bias is provided by a leaf-spring 22 connected to the handles 15 and 16. A guide-post 23 is fixed to the handle 16 and passes through a hole 24 in the handle 15. The angle at which the guide-post is set is such that it is forced against an inner wall of the hole 24 to provide the required lateral urging force. The upper extremity 25 (as viewed in the illustration) of the guide post is bent to act as a limiting stop defining the maximum jaw opening of the scissors.

The lateral-urging means in the scissors of FIG. 3 is constituted by a post 26 attached to the extremity of the handle 16. A pin 27 attached to the extremity of the handle 15 is so positioned as to be forced into contact with an edge surface of the post 26 and hence to act as a cam-follower.

FIG. 4 shows the front end, in cross-section, of an alternative embodiment wherein a manually adjustable cross-cutting pressure can be applied. A spring 28 is positioned within the box junction of the scissors between a bolt 29 and a ball-bearing 30. By tightening the bolt 29, which is preferably fitted with a winged head, into the handle 16, the pressure exerted by the ball 30 on the handle 15 can be increased to provide the desired cross-cutting pressure.

While the invention has been described with reference to preferred embodiments thereof, it will be understood that various modifications may be made to the details of those embodiments while retaining the benefits of omnidirectional cutting ability, and reliable cutting action when the scissors are used in either hand. Moreover it will be appreciated that the precise shape and relative dimensions of both the blades and the handles of the embodiments described are merely illustrative and many modifications may be made thereto. Such modifications are considered within the scope of the present invention which is defined by the appended claims.

I claim:

1. A hand-operated shearing device which comprises a pair of members interconnected by pivot means located between a blade-portion and a handle-portion of each member, said pivot means permitting relative rotation of said members between an open-jaw configuration and a closed configuration, and resilient lateral-urging means effective throughout the range of rotational movement of said members to urge a surface of each of said blade-portions into frictional contact with a surface of the other blade-portion;

wherein the improvement comprises a leaf-spring assembly interconnecting the ends of said handle-portions and adapted to constitute both said jaw-opening means and said lateral-urging means, said assembly comprising a pair of leaf-springs, one end of each leaf-spring being attached to an extremity of a respective one of said handle-portions, and a screw-threaded axle interconnecting the other ends of said leaf-springs, said axle being located parallel to said axis of rotation of said members and threadably engaging at least one of said leaf-springs, whereby upon rotation of said axle said other ends of said leaf-springs are displaced relative to one another along said axle.

2. A device in accordance with claim 1, including an adjusting wheel fixed to the axle and rotatable therewith, whereby through manual rotation of said wheel by an operator of the device, the lateral-urging force exerted by the leaf-springs is selectively adjustable.

* * * * *